United States Patent [19]

Spinner

[11] 4,302,064

[45] Nov. 24, 1981

[54] DETACHABLE COUPLING FOR PRESSURE-MEDIUM-FILLED HF LINES

[76] Inventor: Georg Spinner, Am Eichberg 12, 8152 Feldkirchen-Westerham 1, Fed. Rep. of Germany

[21] Appl. No.: 46,155

[22] Filed: Jun. 6, 1979

[30] Foreign Application Priority Data

Jun. 16, 1978 [DE] Fed. Rep. of Germany ..... 2826478

[51] Int. Cl.[3] ..... H01R 17/12

[52] U.S. Cl. ..... 339/16 C; 174/21 JS; 174/21 C; 339/117 R

[58] Field of Search ..... 339/15, 16 R, 47 R, 339/48, 49 R, 49 B, 16 C, 16 RC, 115 R, 115 C, 117, 177 RE; 137/614.04; 174/21 JS, 21 JC, 21 C, 22 R, 22 C

[56] References Cited

U.S. PATENT DOCUMENTS

| | | | |
|---|---|---|---|
| 2,345,019 | 3/1944 | Van Alstyne | 174/21 JC |
| 2,439,841 | 4/1948 | Carsten et al. | 339/16 C |
| 2,519,933 | 8/1950 | Rouault | 339/16 C |
| 2,545,939 | 3/1951 | Breitenstein | 339/16 C |
| 2,706,646 | 4/1955 | Olson | 137/614.04 |
| 3,076,671 | 2/1963 | Freeman | 137/614.04 |
| 3,649,949 | 3/1972 | McCarthy et al. | 339/16 R |
| 4,106,523 | 8/1978 | Thornton et al. | 137/614.04 |

*Primary Examiner*—John McQuade

*Attorney, Agent, or Firm*—Ostrolenk, Faber, Gerb & Soffen

[57] ABSTRACT

The disclosure concerns a detachable coupling for a pressure-medium-filled high frequency line and/or for a coaxial line and/or for a hollow wave guide. The abutting ends of two sections of the line are gas sealed. A valve arrangement at the abutting ends opens the communication between the line ends when the line sections are coupled and seals the line sections when the line sections are separated. Various valving arrangements are illustrated for various types of lines, coaxial lines and wave guides.

8 Claims, 7 Drawing Figures

FIG.1
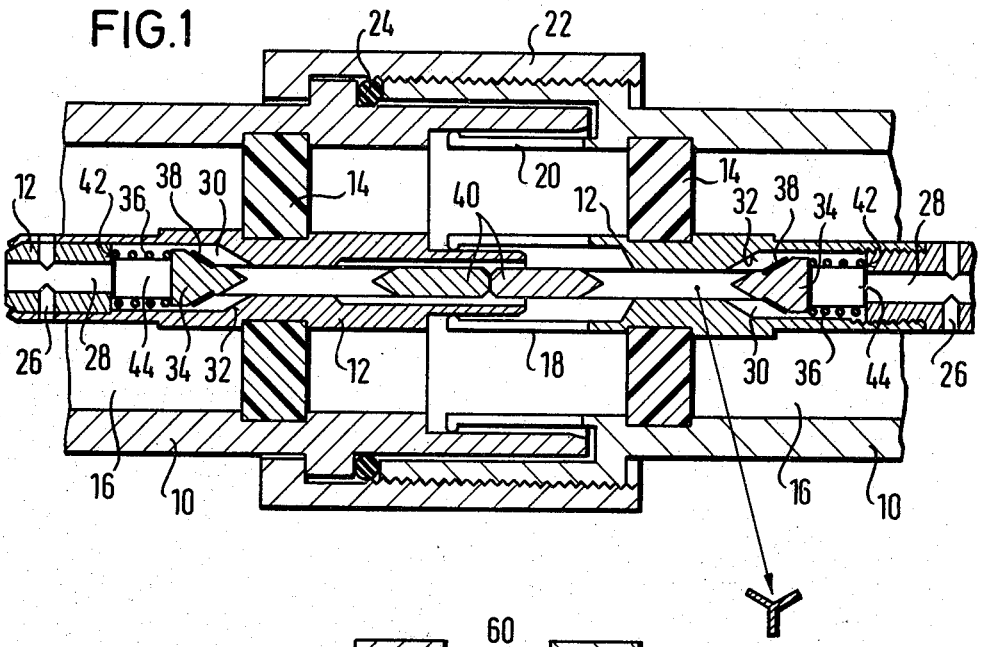
FIG.2
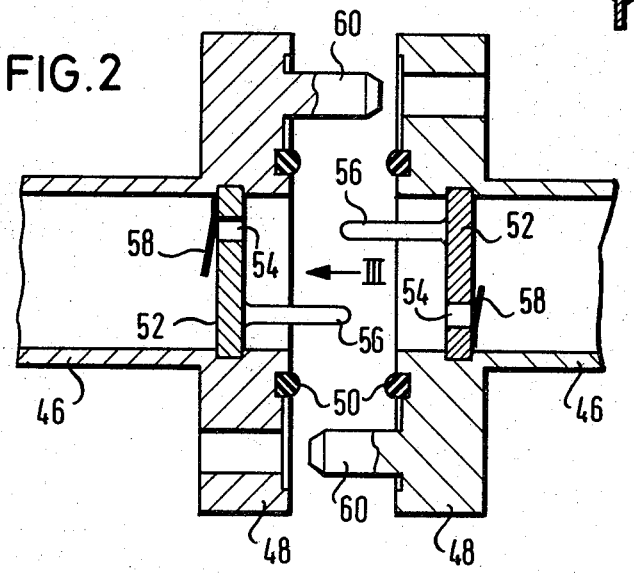
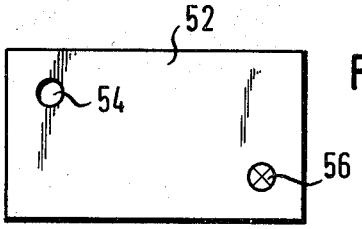
FIG.3

DETACHABLE COUPLING FOR PRESSURE-MEDIUM-FILLED HF LINES

BACKGROUND OF THE INVENTION

The invention pertains to a detachable coupling for pressure-medium-filled HF lines with longitudinally sealed shielding at the line ends.

Such couplings are required in cavity-insulated coaxial lines and high-frequency hollow waveguides which for a variety of reasons are operated with an excess inner pressure. As pressure medium, either dried air or a gas can be used. The air is produced by a corresponding ventilating apparatus and as gas nitrogen or sulphur hexafluoride and similar gases are often used. The ventilation systems themselves ensure constant pressure in the line system.

To supply the gas to the high-frequency line, coaxial connectors are provided with a gas connection bore. Waveguide sections are provided with their own gas injection member. In semiflexible waveguides (oval hollow waveguides) the air injection member is usually combined with the end fitting which simultaneously effects the transformation to the standardized rectangular or circular waveguide. All these fittings require their own supply line for the protective gas, usually in the form of thin copper or aluminium tubes or in the form of hoses. For transporting such lines, frequently a valve is inserted in the filling opening and before transport the lines are pumped up and sent under excess pressure. At the place of use, by suitable lines the air supply or gas supply must be insured.

For certain purposes it is frequently necessary to release and reconnect such couplings lying in coaxial lines. This means that the protective gas can escape and air and moisture can penetrate into the lines. To avoid this, at the ends adjoining the coupling longitudinally sealed means have been provided. However, this interrupts the connection for the protective gas or air in the connected condition. Consequently, at the coupling points bypass lines have been provided which on decoupling or establishment of the coupling had to be separately released or reconnected, a danger of protective gas escaping again existing.

The problem underlying the invention is therefore to ensure the gas connection of the individual line sections via the couplings without using bypass lines, satisfactory sealing being guaranteed after release of the couplings.

SUMMARY OF THE INVENTION

The problem is solved by providing valves in both of two joined line sections. The valves are designed to open automatically when the lines are connected and to close automatically when the lines are separated. When they are open, the valves connect the gas-filled portions of the two line sections. The high-frequency line thus itself serves as air supply line and the valves may be accommodated in the high-frequency chamber or within the inner conductor of coaxial lines. When a coupling is separated, for example a plug connection in the case of coaxial conductors, the air or gas passage through the line is automatically closed, by checkvalves or spring-actuated valves, so that the desired sealing or connection is obtained automatically without additional actuation.

Further expedient developments of the invention in coaxial line couplings or hollow waveguide couplings are apparent from the subsidiary claims.

BRIEF DESCRIPTION OF THE DRAWINGS

FIG. 1 is a sectional view of a coaxial plug connection according to the invention in the connected state, FIG. 2 is a sectional view of a waveguide coupling prior to connection, FIG. 3 is a view in the direction of the arrow III of FIG. 2.

DETAILED DESCRIPTION OF THE PREFERRED EMBODIMENTS

Figure 4:
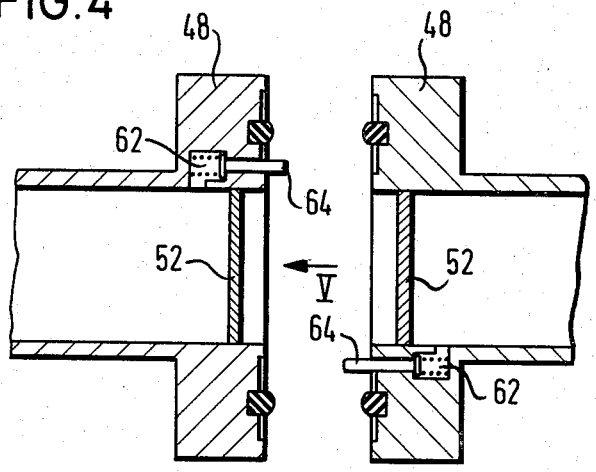
FIG. 4 is a partial section of a hollow waveguide end portion.
Figure 5:
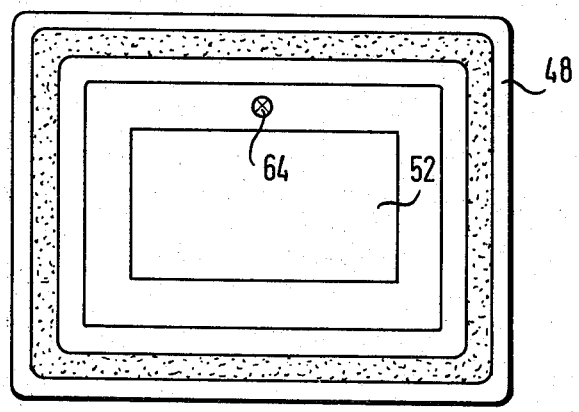
FIG. 5 is a view in the direction of the arrow V according to FIG. 4.

In the example of embodiment according to FIG. 1 the line ends of the two coaxial conductors to be connected, comprising an outer conductor 10 and an inner conductor 12, are provided with a closure or shielding in the form of insulating members 14 which seal the air space 16 between the inner conductor 12 and outer conductor 10 at the coupling point. The coupling is established in the example of embodiment illustrated via inner conductor contact blades 18 and outer conductor contact blades 20 in the form of a plug connection and the coupling is secured by a coupling ring 22. A sealing ring 24 seals the air space of the coupling towards the outside.

The inner conductors 12 are made hollow at least in the region of the line end. They comprise transverse bores 26 which connect the air space 16 to the central longitudinal passage 28 of the inner conductor 12. Provided within the longitudinal passage 28 is a widened portion 30 which has a conical valve seat 32. A valve body 34 is axially displaceable in this widened portion 30 and is pressed under the action of a pressure spring 36 onto the valve seat 32 and in this position seals the longitudinal passage 28. To ensure an air-tight closure the valve body is provided with a resilient gasket, e.g. covered with a silicone hose 38. Each valve body has a valve push member 40 which extends rearwardly towards the connector end and as apparent from FIG. 1 is so dimensioned that in the connected state the two push members 40 of the lines to be coupled engage at their end faces and lift the valves bodies 34 from the valve seats. To ensure that on connection both valve bodies are in fact lifted a stop limit is provided for the valve bodies so that even with unequal displacement resistance both valves always open. The stop is formed by the step 42 at the end of the widened portion 30 and the portion 44 of the valve body on which the helical spring 36 is fitted strikes said step. The valve push members 40 and the portion 44 are provided with longitudinal slits to provide a connection between the longitudinal passage 28 of the one line end via the connection point to the longitudinal passage 28 of the other line end and thus establish communication between the air chambers 16. As apparent from the cross-section of FIG. 1, the arrangement may also be such that the valve push members and/or portion 44 have a cross-like section.

Accordingly, in the coupling position shown in FIG. 1 a continuous connection is established between the air chambers 16 of the two lines. When the connection is released and the end faces of the valve push members 40 separated the springs 36 press the valve bodies onto the valve seat and automatically close the interior of the line in air-tight manner.

FIG. 2 shows a connection between two hollow waveguide end portions 46 which can be coupled by a flange connection 48. Sealing rings 50 are inserted in the end annular grooves of the flanges 48. The cavity of the waveguides 46 is sealed in air-tight manner in each case by a pressure window 52 and each pressure window is provided in the vicinity of one corner with a valve opening 54 and carries near the diagonally opposite corner a valve push member 56. According to the example of embodiment illustrated each valve opening 54 is provided with a flap valve 58 which when the connection is established is raised by the opposite valve push member 56, i.e. is opened. In the example of embodiment according to FIG. 2 the pressure window is set rather far back so that it is protected and only the valve push members 56 project beyond the division plane. They are however protected by locating pins 60 which are inserted into the flanges 48 and cooperate with corresponding locating holes in such a manner that the pins 60 engage in location holes before the valve push members 56 engage in the valve openings 54.

In the example of embodiment according to FIG. 4 the valve 62 is located in the flange member 48, i.e. the valve 62 lies outside the pressure window 52. Each valve 62 projects with a valve push member 64 beyond the flange 48 so that in the connected state the valve is opened via the push member 64 and on release of the connection automatically closes.

Figure 6:
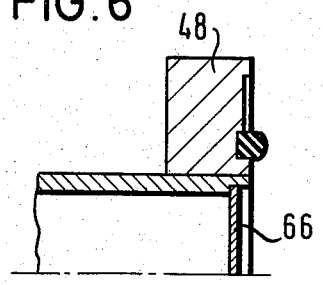
FIG. 6 is a partial section of a hollow waveguide end portion.

FIG. 6 shows an arrangement in which the pressure window 66 is inserted into the flange of the waveguide and forms the front face of the flange. This has the advantage that no dirt can enter and this embodiment is thus expedient even independently of a valve arrangement. To ensure that a flange arrangement equipped with such a pressure window 66 can be connected to other waveguides the edge face in which the pressure window is located must be shifted to the wall cross-section of the waveguide so that contact can take place at the end faces even when a soldering point is present between the flange 48 and the waveguide at the end face.

Valve arrangements as described in the previous examples of embodiment can also be used in the embodiment of FIG. 6.

Figure 7:
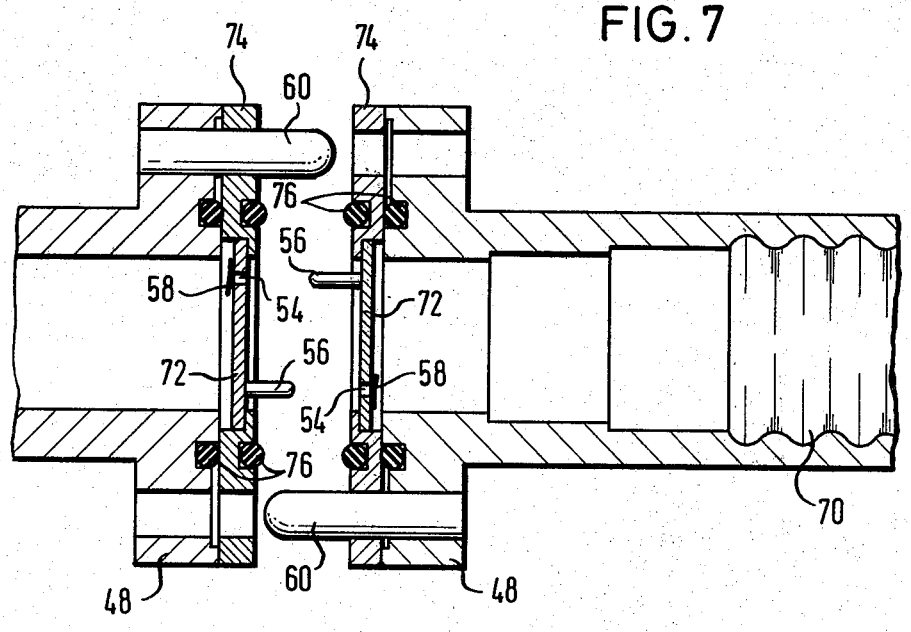
FIG. 7 is a sectional view of a coupling with a hollow waveguide transition member.

FIG. 7 shows a further embodiment in which the waveguide portion on the left is constructed as transition between rectangular cross-section and for example an oval undulated surface 70. In this example of embodiment pressure windows 72 are provided which are disposed in intermediate ring discs 74 which are placed on the flanges 48 and connected in air-tight manner to the latter. When the coupling is established the intermediate ring discs 74 are tensioned against each other by means of the flanges 48, ensuring a sealing via the sealing rings 76. Once again, valves 54, 58 with valve push members 56 according to example of embodiment of FIGS. 2 and 3 or other valve arrangements may be used.

What is claimed is:

1. A detachable coupling for a coaxial line containing a pressurized gas, said coupling comprising:

a first coaxial line having a first inner conductor and a first outer conductor and having a first end;

a second coaxial line having a second inner conductor and a second outer conductor and having a second end;

said first and second inner conductors being filled with a gas under pressure;

said first and second ends being joinable to each other in such a manner as to connect said first and second inner conductors, and to connect said first and second outer conductors;

each of said coaxial lines having a respective insulating member at its respective said end for retaining said gas in said line under pressure;

each of said ends having a valve disposed in its respective said inner conductor, said valves defining a flow path connecting the interiors of said inner conductors when said ends are joined to each other and for maintaining the interiors of said inner conductors sealed from the atmosphere when said ends are not joined to each other; said valves operating automatically to open when said ends are joined and to close automatically when said ends are separated.

2. The coupling of claim 1, wherein said insulating members define a gas chamber between them when said ends are joined, the interiors of said inner conductors communicating with said gas chamber via said valves when said ends are joined.

3. The coupling of claim 1, wherein said valves are disposed in said insulating members.

4. The coupling of claim 2, wherein at least one of said inner conductors includes coupling blades for engaging the other of said inner conductors, said coupling blades having slots formed therein through which said interiors of said inner conductors communicate with said gas chamber when said ends are joined.

5. The coupling of claim 3 or claim 4, wherein each of said valves comprises a valve seat formed in the respective said inner conductor, a valve body for engaging said valve seat to close said valve, and a valve actuating rod for urging said valve body away from said valve seat to open said valve when said ends are joined, said valve actuating rods each being disposed in the respective said inner conductor in such a manner as to meet each other to push their respective said valve bodies away from the respective said valve seats when said ends are joined.

6. The coupling of claim 5, wherein said valve seats and said valve bodies are conical.

7. The coupling of claim 6, wherein each of said valves further comprises a respective spring means for urging said valve body against said valve seat.

8. The coupling of claim 5, wherein each of said valves further comprises means for preventing said valve body from being moved more than a certain predetermined distance from said valve seat, for ensuring that when said ends are joined both of said valves are opened.

* * * * *